US009344809B2

(12) United States Patent
Muza et al.

(10) Patent No.: US 9,344,809 B2
(45) Date of Patent: May 17, 2016

(54) DIGITAL ACOUSTIC LOW FREQUENCY RESPONSE CONTROL FOR MEMS MICROPHONES

(71) Applicant: Robert Bosch GmbH, Stuttgart (DE)

(72) Inventors: John Matthew Muza, Venetia, PA (US); Philip Sean Stetson, Wexford, PA (US); Michael James Daley, Canonsburg, PA (US); Davin Luther Yuknis, Wexford, PA (US); Joseph R. Fitzgerald, San Diego, CA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/211,583

(22) Filed: Mar. 14, 2014

(65) Prior Publication Data

US 2014/0270273 A1 Sep. 18, 2014

Related U.S. Application Data

(60) Provisional application No. 61/782,399, filed on Mar. 14, 2013.

(51) Int. Cl.
*H04R 23/00* (2006.01)
*H04R 19/00* (2006.01)

(52) U.S. Cl.
CPC ..... *H04R 23/00* (2013.01); *H04R 19/005* (2013.01); *H04R 2201/003* (2013.01)

(58) Field of Classification Search
CPC ..... H04R 23/00; H04R 3/00; H04R 3/04; H04R 2201/003; H04R 1/28; H04R 1/04; H04R 1/20; H04R 1/22; H04R 1/222; H04R 1/32; H04R 1/326; H04R 1/34; H04R 1/342; H04R 1/2823; H04R 1/2846
USPC ..... 381/150, 369, 174, 122
See application file for complete search history.

(56) References Cited

U.S. PATENT DOCUMENTS 3,835,263 A 9/1974 Killion
6,760,462 B1 7/2004 Thigpen
(Continued)

FOREIGN PATENT DOCUMENTS

EP 2242288 10/2010
GB 641718 8/1950
(Continued)

OTHER PUBLICATIONS

PCT International Search Report and Written Opinion for Application No. PCT/US2014/027732 dated Jul. 7, 2014 (10 pages).

*Primary Examiner* — Ahmad F Matar
*Assistant Examiner* — Sabrina Diaz
(74) *Attorney, Agent, or Firm* — Michael Best & Friedrich LLP

(57) ABSTRACT

A system and method for controlling and adjusting a low-frequency response of a MEMS microphone. The system comprising the MEMS microphone, a controller, and a memory. The MEMS microphone includes a membrane and a plurality of air vents. The membrane configured such that acoustic pressures acting on the membrane cause movement of the membrane. The plurality of air vents are positioned proximate to the membrane. Each air vent of the plurality of air vents are configured to be selectively positioned in an open position or a closed position. The controller determines an integer number of air vents to be placed in the closed positioned, and generate a signal that causes the integer number of air vents to be placed in the closed position and causes any remaining air vents to be placed in the open position.

22 Claims, 7 Drawing Sheets

(56) References Cited

U.S. PATENT DOCUMENTS

| | | | | |
|---|---|---|---|---|
| 7,233,679 | B2 | 6/2007 | Muthuswamy et al. | |
| 8,081,782 | B2 | 12/2011 | Klinghult | |
| 8,363,874 | B2 | 1/2013 | Grell et al. | |
| 8,447,054 | B2 | 5/2013 | Bharatan et al. | |
| 2011/0110550 | A1 | 5/2011 | Bharatan et al. | |
| 2011/0268292 | A1* | 11/2011 | Suvanto et al. | 381/92 |
| 2013/0223654 | A1* | 8/2013 | Dehe et al. | 381/174 |
| 2014/0294218 | A1* | 10/2014 | Suvanto et al. | 381/337 |

FOREIGN PATENT DOCUMENTS

| | | |
|---|---|---|
| JP | 59077795 | 5/1984 |
| WO | 2012/114159 | 8/2012 |

* cited by examiner

DIGITAL ACOUSTIC LOW FREQUENCY RESPONSE CONTROL FOR MEMS MICROPHONES

RELATED APPLICATIONS

This patent application claims priority from provisional U.S. Patent Application No. 61/782,399 filed Mar. 14, 2013, entitled, "DIGITAL ACOUSTIC LOW FREQUENCY RESPONSE CONTROL FOR MEMS MICROPHONES," the disclosure of which is incorporated herein, in its entirety, by reference.

BACKGROUND

The present invention relates to systems and methods for adjusting and controlling the performance of a microphone system. More specifically, the present invention relates to methods of adjusting the performance of a microphone system in response to low-frequency sounds.

SUMMARY

The performance of a microphone system can vary depending upon the frequency of sound acting upon the microphone diaphragm/membrane. For example, depending upon the construction of the microphone system, the microphone systems ability to respond to sound pressures (i.e., the microphone's sensitivity) can significantly drop off at low frequencies.

The systems and methods described below provide mechanisms for adjusting and controlling the response of the microphone at various frequencies. More specifically, the systems and methods described below provide a series of air vents positioned proximate to the microphone diaphragm/membrane. The individual vents can be controllably opened or closed to control the amount of air (i.e., acoustic pressure) that is able to pass through to the back-volume. By controlling the number of air vents that are opened or closed, the ability of the microphone to respond to acoustic pressures at a given frequency can be adjusted.

In one embodiment, the invention provides a microphone system for controlling a low-frequency response of a MEMS microphone. The microphone system comprising the MEMS microphone, a controller, and a non-transient computer-readable memory. The MEMS microphone includes a membrane and a plurality of air vents. The membrane has a first side and a second side, and is configured such that acoustic pressures acting on the membrane cause movement of the membrane. The plurality of air vents are positioned proximate to the membrane. Each air vent of the plurality of air vents are configured to be selectively positioned in an open position or a closed position. Air can move through an open air vent between the first side and the second side of the membrane. The controller is coupled to the plurality of air vents. The memory stores instructions that, when executed by the controller, cause the controller to determine an integer number of air vents to be placed in the closed positioned, and generate a signal that causes the integer number of air vents to be placed in the closed position and causes any remaining air vents to be placed in the open position.

In another embodiment, the invention provides a method of adjusting a low frequency response of a MEMS microphone. The MEMS microphone includes a membrane and a plurality of air vents. The membrane has a first side and a second side, and is configured such that acoustic pressures acting on the membrane cause movement of the membrane. The plurality of air vents are positioned proximate to the membrane. Each air vent of the plurality of air vents are configured to be selectively positioned in an open position or a closed position. Air can move through an open air vent between the first side and the second side of the membrane. A controller, coupled to the plurality of air vents, determines an integer number of air vents to be placed in the closed position. The controller also generates a signal that causes the integer number of air vents to be placed in the closed position and causes any remaining air vents to be placed in the open position.

In some embodiments, the default position of the plurality of air vents is open when power is not applied. This allows maximum air flow bypassing the membrane and makes the MEMS structure more robust to high pressure air blow stresses during manufacturing.

Other aspects of the invention will become apparent by consideration of the detailed description and accompanying drawings.

DETAILED DESCRIPTION

Figure 1:
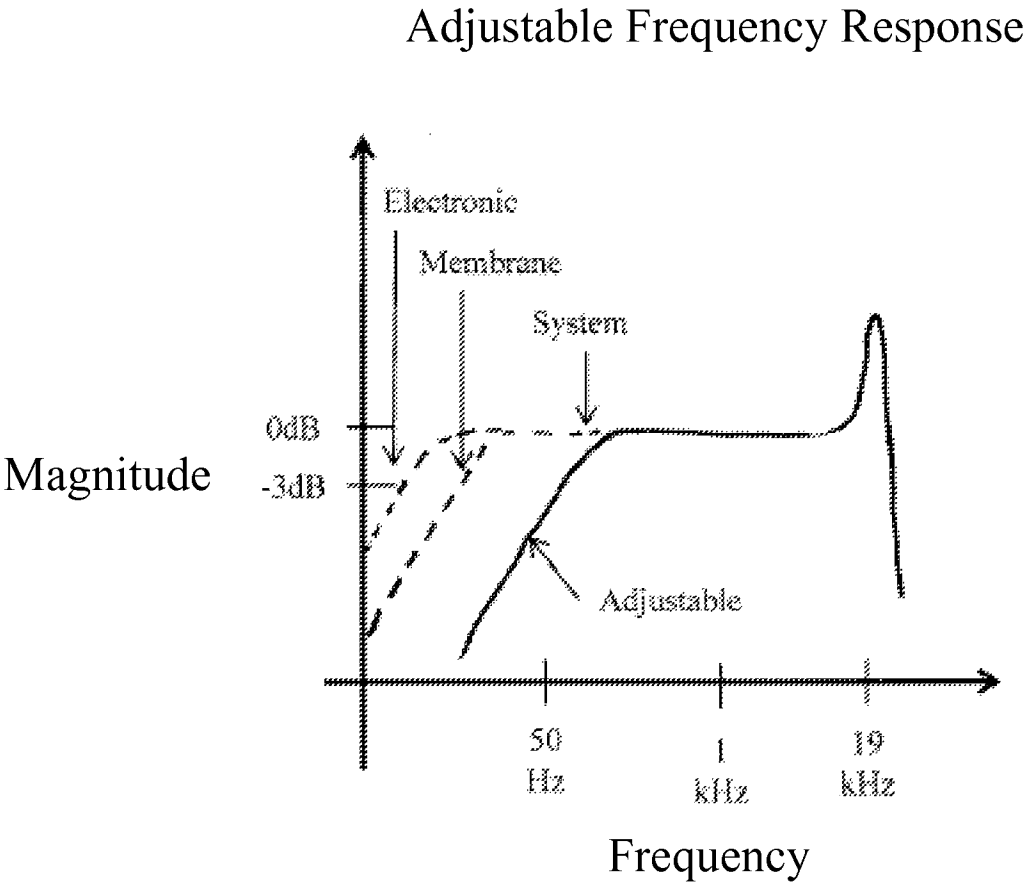
FIG. 1 is a graph of an adjustable low-frequency response of a MEMS microphone, such as illustrated in FIGS. 2A and 2B.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using other known means including direct connections, wireless connections, etc. The use of the term "open" when used in relation to the condition of an air vent means that the air vent is in the condition which allows the maximum possible amount of air leak that the air vent is capable of providing. Also, the use of the term "closed" when used in relation to the condition of an air vent means that the air vent is in the conditions which allows no air leak.

It should also be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention. Alternative configurations are possible.

The response and sensitivity of a microphone can vary for different frequencies. The displacement magnitude of the microphone diaphragm/membrane (and the ability of the microphone to respond to acoustic pressures) remains fairly constant for acoustic pressures of similar intensity across a range of frequencies. However, the sensitivity of the microphone is impaired when the frequency of the sound is too high or too low.

The low-frequency response performance of a microphone—and, particularly, the starting frequency of the gradual drop off in response performance—is related to the back volume of air behind a movable membrane and the effective air leak path through the membrane (i.e., the amount of and rate at which air/acoustic pressure is able to move from the top surface of the membrane to the back volume of the microphone). However, due the manufacturing processes and packaging tolerances inherent to MEMS microphone systems, these parameters are subject to statistically significant variability. In many cases, the variability in low-frequency response performance can be relatively large and exceed product requirements. Furthermore, additional factors such as temperature, ambient pressure, and humidity can also affect the low-frequency response performance of the MEMS microphone.

FIG. 1 is a graph of the frequency response for a microphone system. The overall frequency response and more specifically the low-frequency corner of the microphone system are based upon a plurality of factors, such as the electronics and membrane used in the microphone system. FIG. 1 shows the native low-frequency corners of the electronics and the membrane. The low-frequency corner of the microphone system is higher than the native electronic and membrane low-frequency corners. This difference allows for the low-frequency corner of the microphone system to be adjusted.

The low-frequency response of a MEMS microphone can be adjusted by providing an air vent (i.e., auxiliary air leak path) for the air to flow between the front/top of the membrane and the back volume. The amount of air leak through the air vent might be controlled in an analog fashion by adjusting the displacement of a moveable member of a single air vent to a specific location (i.e., effective opening dimensions) on the continuum throughout the total range of the air vent. However, such analog control would require a precise, adjustable voltage to be applied to the moveable member of the air vent. It would also require knowledge of the linearity mechanics of the movable member in response to electrostatic forces. In other words, a given voltage may not produce the same displacement in different microphone systems due to manufacturing process variability.

The invention described herein provides a digital circuit and MEMS system which allow a fine scale range adjustment for the low-frequency response after the product manufacturing process by either a vendor or a customer/end-user. This post-manufacturing measurement and subsequent correction can yield a final tolerance of the low-frequency response much tighter than current manufacturing capabilities. The systems described below enable the user to adjust the frequency response during microphone operation in the end-system (e.g., a cell phone microphone). Additionally, a microphone controller can be programmed to detect a low-frequency air impulse pressure event and adjust the frequency response automatically to maintain the dynamic range of the main acoustic signal. This allows for superior linearity which improves performance of end-user product software algorithms.

Furthermore, microphones that have a low −3 dB corner frequency generally take a longer time period once power to the component is applied as the MEMS diaphragm/membrane settles into its final steady-state position. To alleviate this performance trade-off, a controllable air leak path enables a much faster settling of the system upon power-up and then switch to the desired −3 dB corner frequency.

Figure 2A:
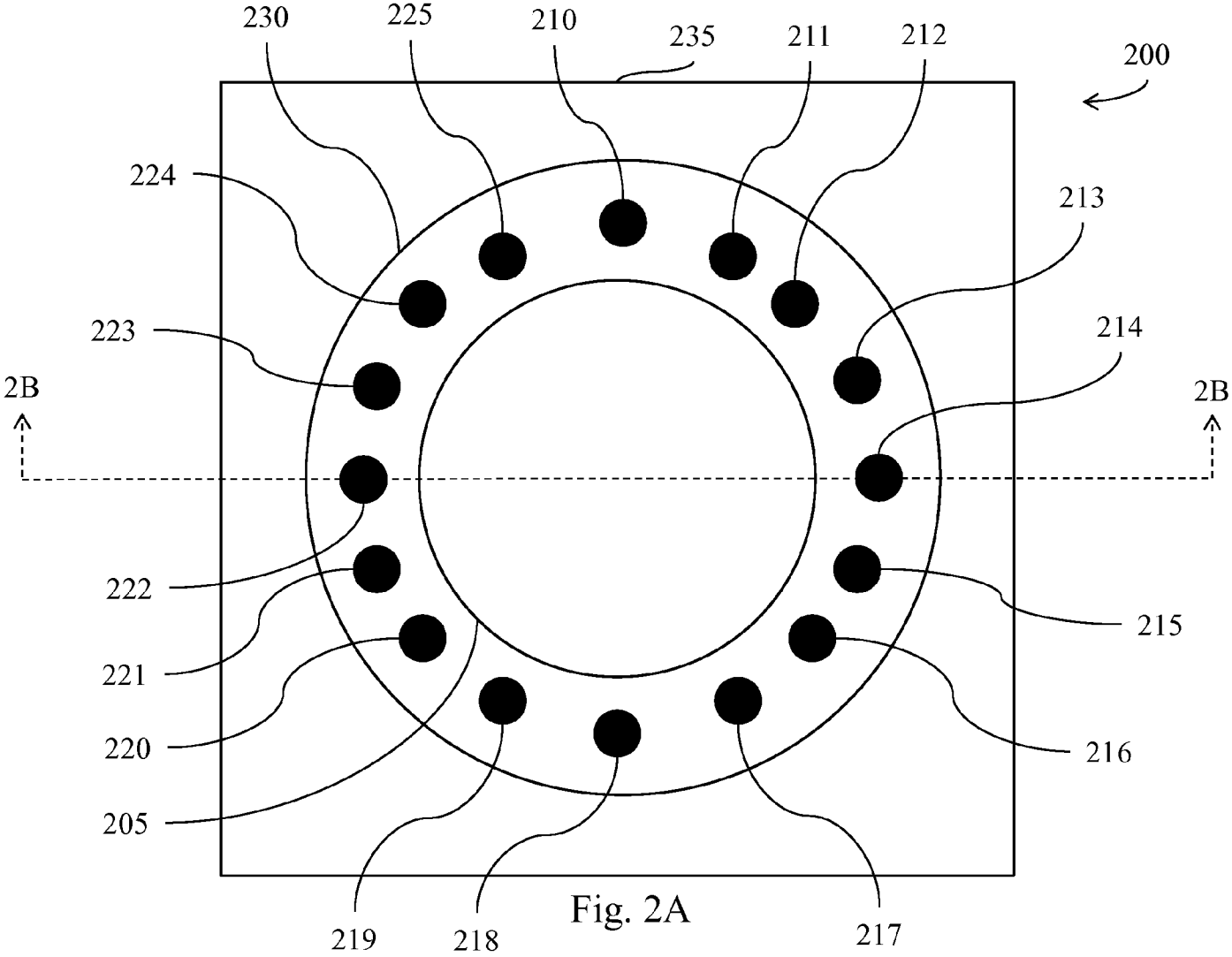
FIG. 2A is a cross-sectional bottom view of a MEMS microphone.
Figure 2B:
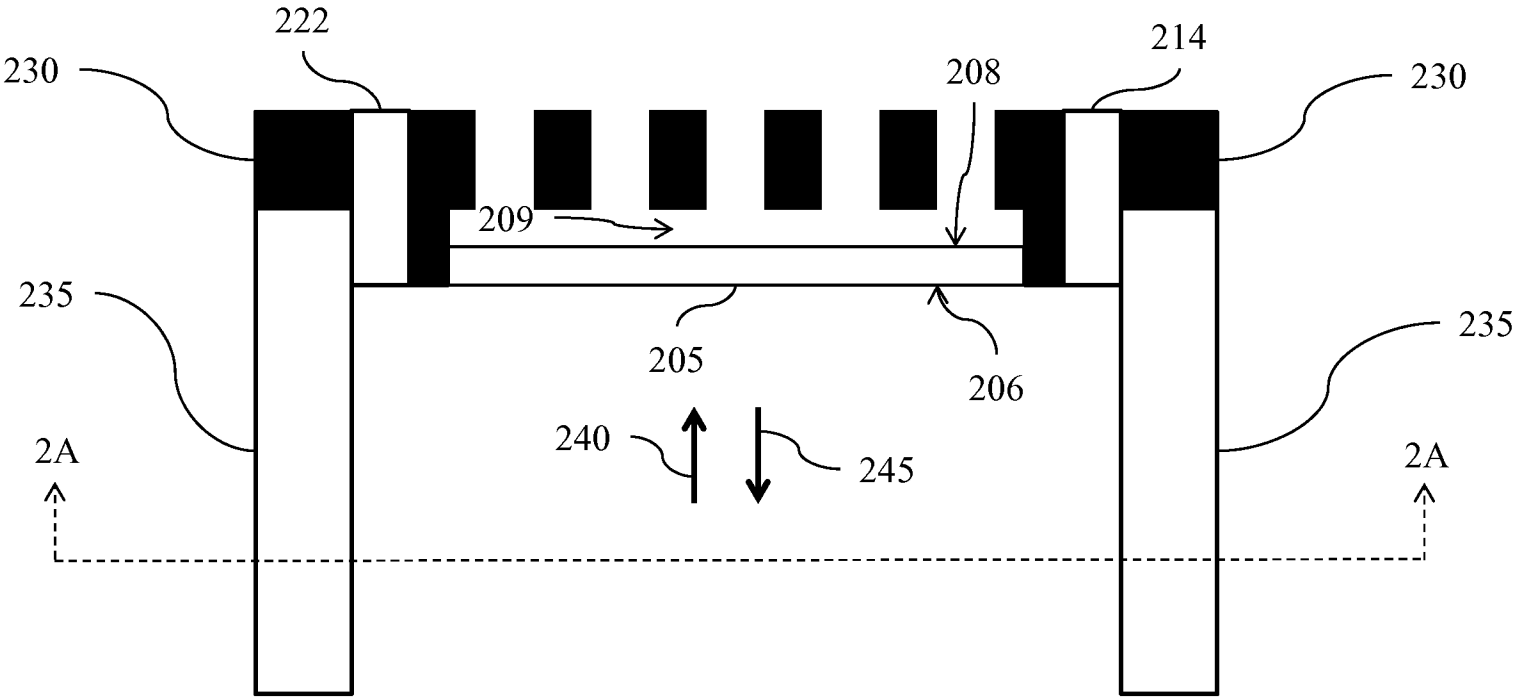
FIG. 2B is a cross-sectional side view of the MEMS microphone of FIG. 2A.

FIG. 2A is a MEMS microphone 200 in which the effective size of the auxiliary air leak path is controlled in a digital manner by fully opening or fully closing an integer number of vents. The MEMS microphone 200 includes a circular, moveable membrane 205, 16 air vents 210-225 positioned around the circumference of the membrane 205, a stationary backplate 230, and a support structure 235. FIG. 2B shows the same MEMS microphone of FIG. 2A from a cross-sectional side perspective. As shown in FIG. 2B, the membrane 205 has a front side 206 and a back side 208. A back volume 209 exists between the membrane 205 and the back plate 230. Acoustic pressures acting on the membrane 205 cause movement of the membrane 205 in the directions of arrow 240 and arrow 245. Movement of the membrane 205 relative to the back plate 230 causes changes in the capacitance between the membrane 205 and the back plate 230. This changing capacitance generates an electric signal indicative of the acoustic pressures acting on the membrane 205. The air vents 210-225 allow for a controllable amount of air leak between the front side 206 and the back side 208 of the membrane 205. Air is able to move through the one or more open air vents and air movement is restricted by the one or more closed air vents. The air leak through the membrane 205 itself is relatively minor in comparison to the overall acoustic pressure. Therefore, the low-frequency response of the MEMS microphone 200 is dominated by these auxiliary air leak paths of the plurality of air vents 210-225. More specifically, the low frequency response of the MEMS microphone 200 is adjusted by controlling the integer number of air vents that are open and closed. The adjustable range is determined by the dimensions of each air vent, while the resolution of the system is governed by the number of controllable air vents in the system. These parameters can be determined and defined during the design of the system.

Figure 3A:
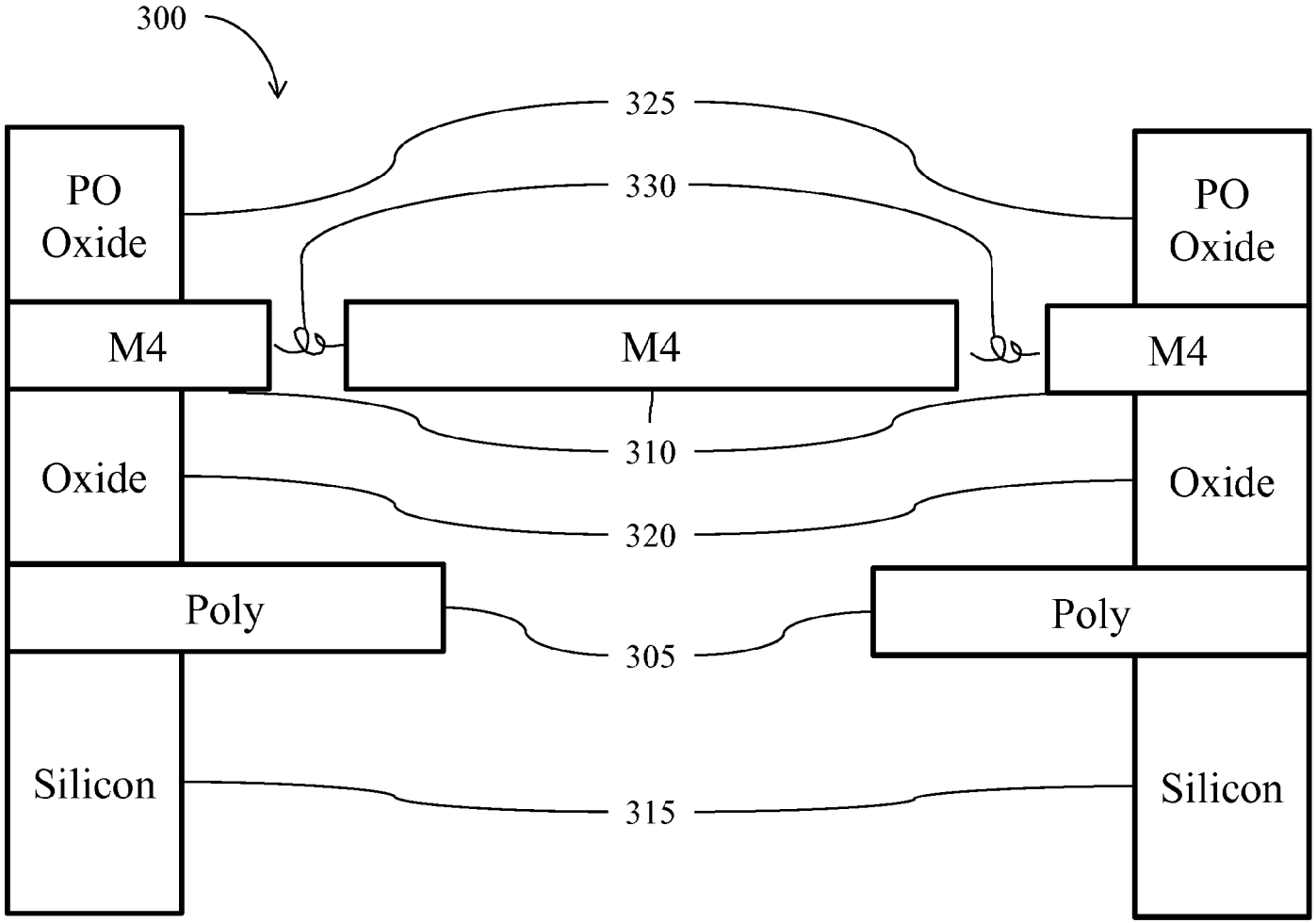
FIG. 3A is a cross-sectional side view of a single air vent of the MEMS microphone of FIGS. 2A and 2B in an open condition.
Figure 3B:
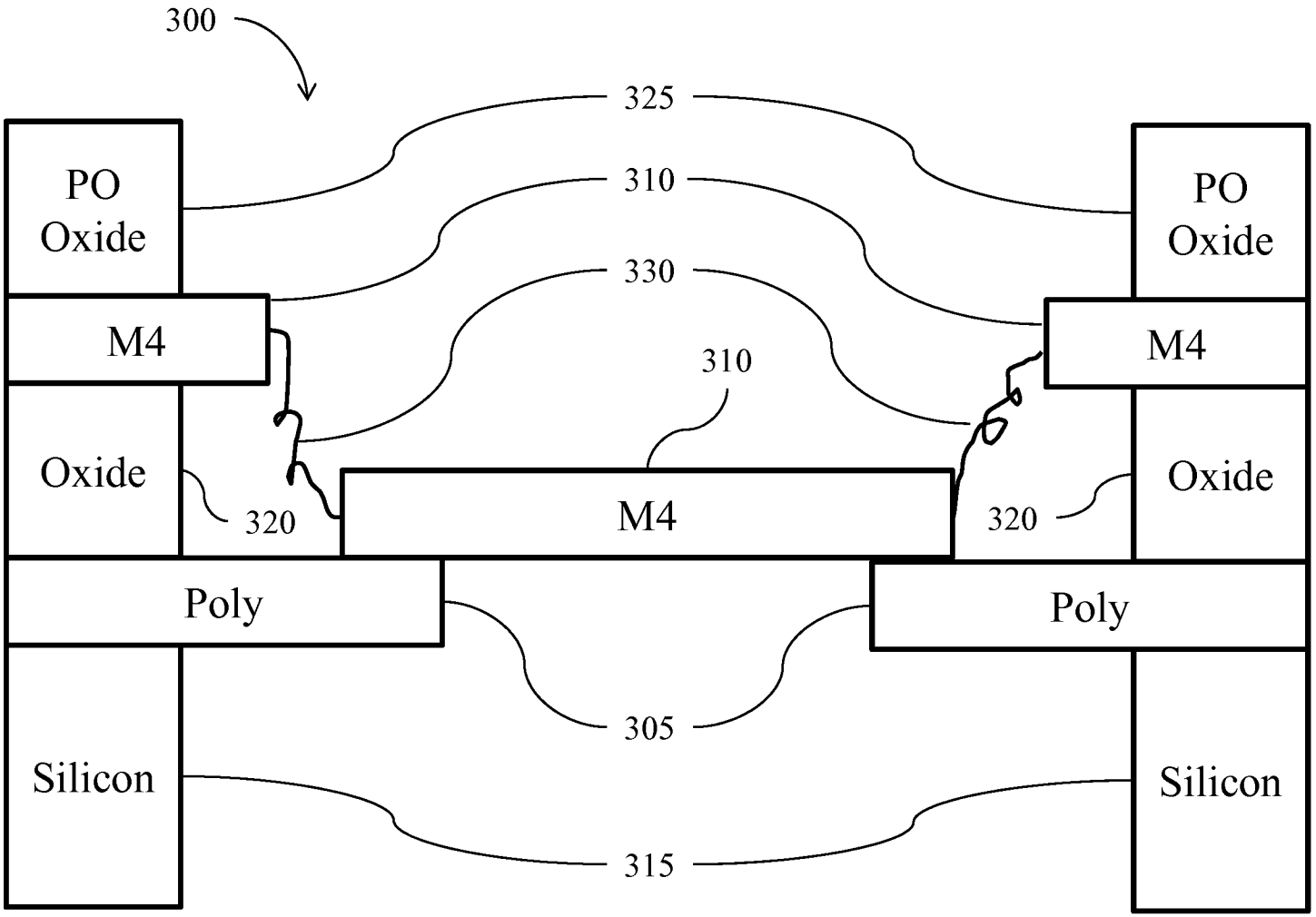
FIG. 3B is a cross-sectional side view of the single air vent of FIG. 3A in a closed condition.

FIGS. 3A and 3B are cross-sectional side views of a control mechanism 300 for an individual air vent. The control mechanism 300 includes a poly layer 305, a metal later 310, a silicon layer 315, an oxide layer 320, and a protective overcoat ("PO") oxide layer 325. The poly layer 305 is support by the silicon layer 315 underneath. The oxide layer 320 is positioned between the poly layer 305 and the metal layer 310 in order to electrically isolate the two layers. The PO oxide layer 325 is positioned above the metal layer 310. In this example, the metal layer 310 is M4.

While the poly layer 305 is fixed and immovable, the metal layer 310 is moveable and, in some constructions, deformable. The poly layer 305 is kept at a ground voltage potential (i.e., 0 Volts) and the voltage of the metal layer 310 is governed by a digital control signal. To close the air vent, a voltage $V_x$ is applied to the metal layer 310. The voltage $V_x$ is defined to be greater than a pull-in voltage. The pull-in voltage is the voltage necessary for the electrostatic attraction between the metal layer 310 and the poly layer 305 to overcome the mechanical resistance holding the metal layer 310 in place. When the pull-in voltage is exceeded, the metal layer 310 snaps-down and contacts the poly layer 305, thus sealing the air vent. As such, for the air vent to remain in the open condition, a voltage less than the pull-in voltage is applied to the metal layer (e.g., ~0 Volts). The exact value of the pull-in voltage is defined by the material and size of the metal layer 310 and the design of the support mechanism for the metal layer 310.

FIGS. 3A and 3B include a pair of springs 330 coupling the portions of the metal layer 310 to each other. These springs 330 are included to illustrate the deformable (i.e., stretching and bending) nature of the metal layer 310 material. It is not necessarily required that an air vent cover be attached to the metal layer 310 by a physical spring. Instead, the metal layer 310 can be a solid layer that is stretched to cover the air vent opening in the poly layer 305 when the pull-in voltage is exceeded. However, in some other embodiments, a separate air vent cover can be coupled to the metal layer 310 by springs 330 or another mechanism (e.g., anchors or clamps).

FIG. 3A is an example of the air vent in the open position (i.e., a first condition). As noted above, the voltage applied to the metal layer 310 in this example is less than the pull-in voltage. The air vent is not sealed because the electrostatic attraction between the metal layer 310 and the poly layer 305 is not great enough to overcome the mechanical restraining force of the metal layer 310.

FIG. 3B is an example of the air vent in the closed position (i.e., a second condition). The voltage applied to the metal layer 310 in this example is greater than the pull-in voltage. The air vent is sealed because the electrostatic attraction between the metal layer 310 and the poly layer 305 is greater than the mechanical restraining force of the metal layer 310.

Figure 4:
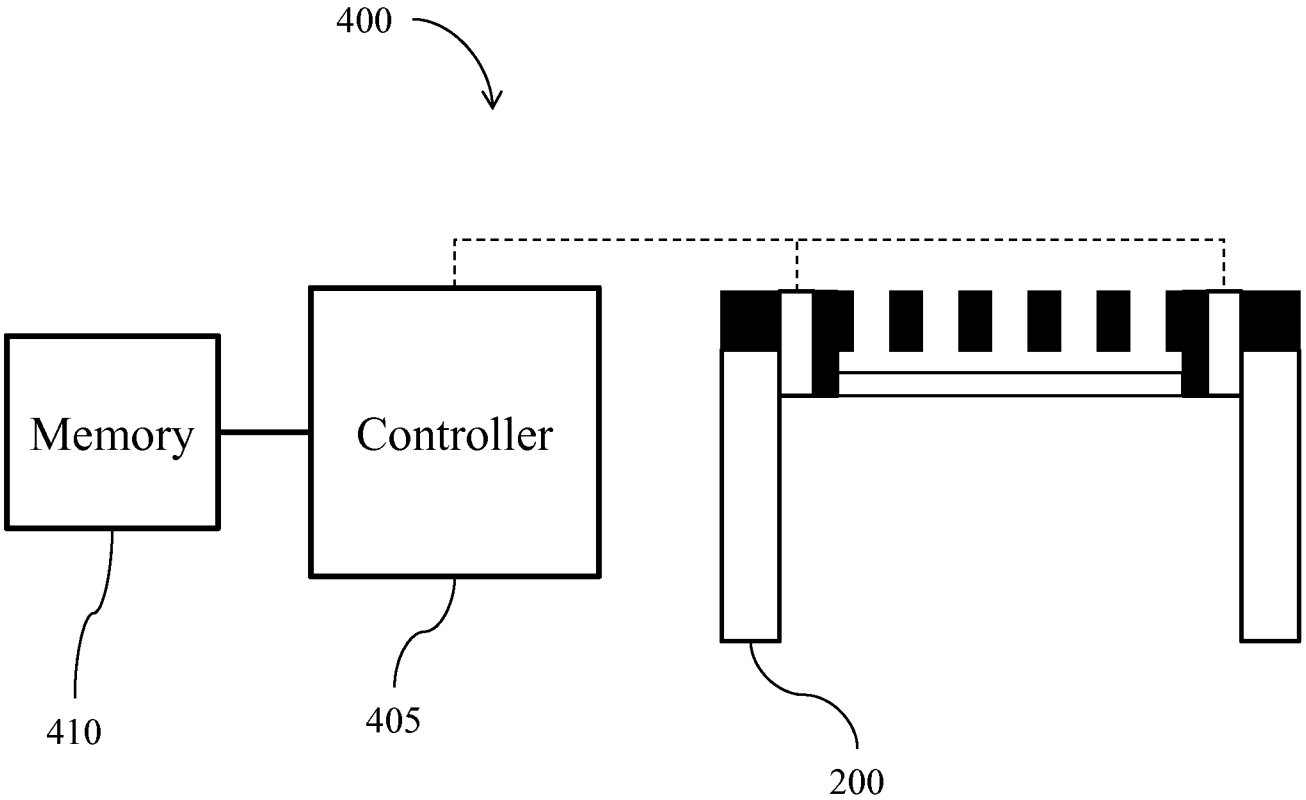
FIG. 4 is a block diagram of a control system for the MEMS microphone of FIGS. 2A and 2B.

FIG. 4 is a system level view of a microphone system 400. The microphone system 400 includes a MEMS microphone 200, a controller 405, and a non-transient computer-readable memory 410. The memory 410 is coupled to the controller 405. The controller 405 is able to individually control each of the air vents 210-225 to be either in the open position or the closed position. The controller 405 is coupled to the plurality of air vents 210-225 and transmits a digital control signal to each of the air vents. The digital control signal indicates either a Bit=0 condition or a Bit=1 condition for each of the air vents. A Bit=0 condition causes a voltage less than the pull-in voltage to be applied to the metal layer 310 of the air vent. For example, a Bit=0 condition may result is a voltage of 0 Volts to be applied to the metal layer 310. As a result, the air vent remains in the open position. However, a Bit=1 condition causes a voltage greater than or equal to the pull-in voltage to be applied to the metal layer of the respective air vent. As a result, the air vent is closed.

In the examples illustrated in FIGS. 3A and 3B, a voltage must be applied to the metal layer 310 of the air vent in order to close the air vent. As such, the default position of the air vent (i.e., when power is not applied or available) is the open position. As a result, when power is not applied to the microphone system 400, every air vent is in the default/open position. This allows for maximum air flow to bypass the membrane 205 and may protect the membrane from high pressure air blow when the device is not in use.

In some constructions, the controller 405 is configured to generate 16 separate 1-bit output signals (i.e., one for each air vent). However, in other constructions, the controller 405 generates a multi-bit code that controls the air vents. The controller 405 in this example indicates the number of air vents to be closed by a four-bit binary code (XXXX) Applying the code 0000 will open all of the air vents 210-225 and yield the highest low frequency corner for the MEMS microphone 200. Conversely, applying the code 1111 will close all of the air vents 210-225 and yield the lowest low frequency corner of the MEMS microphone 200.

In some constructions, the value of the code is determined at the time of manufacture or testing and is stored in the memory 410. The controller 405 accesses the memory 410 to retrieve the code and determines the appropriate digital control signal for each of the 16 air vents 210-225. In other constructions, the controller 405 is configured to perform an assessment of ambient conditions (e.g., temperature) and other system conditions at start-up of the device. Based on this assessment, the controller 405 determines an appropriate code that is used to until the device is powered off.

In still other constructions, the controller 405 continually monitors ambient conditions (e.g., temperature) and microphone performance, determines an appropriate number of vents to open based on the observed conditions, and generates an appropriate code in real-time during operation of the microphone. For example, in some constructions, the controller 405 is configured to detect a low-frequency air impulse pressure event (e.g., car door slams, device is dropped, air blow of compressed air, wind noise, etc.). When such an event is detected, the controller 405 may change the integer number of air vents that are closed.

Figure 5:
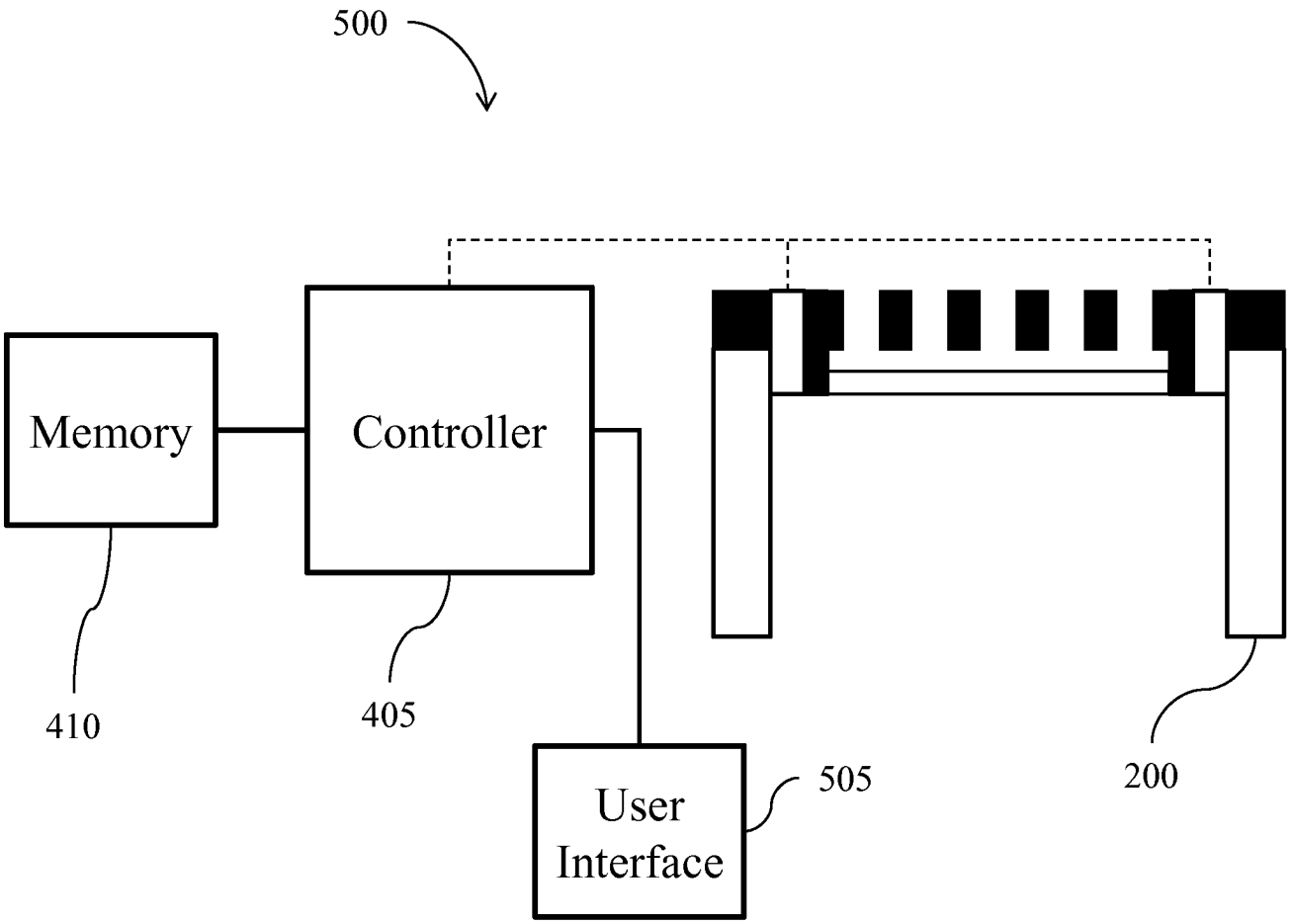
FIG. 5 is a block diagram of another control system for the MEMS microphone of FIGS. 2A and 2B.

FIG. 5 is another example of a microphone system 500 including the MEMS microphone 200. Similar to the microphone system 400 of FIG. 4, microphone system 500 also includes a controller 405 and a memory 410. However, microphone system 500 also includes a user interface 505 coupled to the controller 405. Through the user interface, a user is able to directly indicate the number of vents to be closed (for example, by entering a four digit binary code as described above). This configuration allows the user to adjust the low-frequency response of the MEMS microphone 200 during operation of the microphone system 500. The user can adjust the low-frequency response of the MEMS microphone 2 to compensate for an environmental condition, such as high wind.

Thus, the invention provides, among other things, a microphone system including a plurality of controllable air vents, wherein the low frequency response performance can be adjusted by opening or closing an integer number of the controllable air vents. It is noted that the systems and methods are described above in reference to CMOS-MEMS technology due to the high number of connections that are required between the MEMS element and the controlling circuitry. However, the systems could also be applied to other systems and platforms including, for example, other types of MEMS technologies. Various features and advantages of the invention are set forth in the following claims.

What is claimed is:

1. A microphone system, the microphone system comprising:

a MEMS microphone, the MEMs microphone including a membrane having a first side and a second side, the membrane configured such that acoustic pressures acting on the membrane cause movement of the membrane, and a plurality of air vents positioned proximate to the membrane, each air vent of the plurality of air vents being configured to be selectively positioned in an open position and a closed position such that air can move through an open air vent between the first side and the second side of the membrane;

a controller coupled to the plurality of air vents; and a non-transient computer-readable memory storing instructions that, when executed by the controller, cause the controller to determine an integer number of air vents to be placed in the closed position, and generate a signal that causes more than one air vent of the plurality of air vents to transition from the open position to the closed position in response to the signal, and causes the integer number of air vents to be placed in the closed position and any remaining air vents to be placed in the open position after the transition.

2. The microphone system of claim 1, wherein each air vent of the plurality of air vents is positioned coplanar to the membrane.

3. The microphone system of claim 1, wherein the instructions stored on the memory, when executed by the controller, cause the controller to determine the integer number of air vents to be placed in the closed position by accessing a predefined integer number stored in the memory.

4. The microphone system of claim 1, wherein the signal generated by the controller includes a binary output for each air vent of the plurality of air vents indicating whether the air vent is to be placed in the closed position.

5. The microphone system of claim 4, wherein the binary output for each air vent of the plurality of air vents includes a high value or a low value, and wherein the air vent is closed when the binary output includes a high value and the air vent is opened when the binary output includes a low value.

6. The microphone system of claim 1, wherein the signal generated by the controller includes a multiple digit binary output representation of the integer number.

7. The microphone system of claim 1, wherein the microphone system further comprises a user interface coupled to the controller and the instructions stored on the memory, when executed by the controller, cause the controller to determine the integer number of air vents to be placed in the closed position based at least in part on input received from the user interface.

8. The microphone system of claim 1, wherein each air vent of the plurality of air vents includes a moveable member and a stationary member, and wherein the signal generated by the controller causes an air vent to close by applying a voltage to at least one of the moveable member and the stationary member such that the moveable member is pulled into contact with the stationary member.

9. The microphone system of claim 1, wherein the plurality of air vents are configured to be placed in the open position when power is not applied to the microphone system.

10. The microphone system of claim 9, wherein the instructions stored on the memory, when executed by the controller, cause the controller to determine the integer number of air vents to be placed in the closed position by accessing a predefined integer number stored in the memory upon power being applied to the microphone system.

11. The microphone system of claim 1, wherein the instructions stored on the memory, when executed by the controller, cause the controller to generate a second signal that causes one air vent of the plurality of air vents to transition from the open position to the closed position in response to the second signal.

12. The microphone system of claim 1, wherein the instructions stored on the memory, when executed by the controller, cause the controller to detect an ambient condition, and cause the controller to determine the integer number of air vents to be placed in the closed position based at least in part on the detected ambient condition.

13. A method of adjusting a low frequency response of a MEMS microphone, the MEMS microphone including a membrane including a first side and a second side, the membrane configured such that acoustic pressures acting on the membrane cause movement of the membrane, and a plurality of air vents positioned proximate to the membrane, each air vent of the plurality of air vents being configured to be selectively positioned in an open position and a closed position such that air can move through an open air vent between the first side and the second side of the membrane, the method comprising:

determining, by a controller, an integer number of air vents to be placed in the closed position; and generating, by the controller, a signal that causes more than one air vent of the plurality of air vents to transition from the open position to the closed position in response to the signal, and causes the integer number of air vents to be placed in the closed position and any remaining air vents to be placed in the open position after the transition.

14. The method of claim 13, wherein determining the integer number of air vents to be placed in the closed position includes accessing, by the controller, a predefined integer number stored in a memory.

15. The method of claim 13, wherein generating the signal includes a binary output for each air vent of the plurality of air vents indicating whether the air vent is to be placed in the closed position.

16. The method of claim 15, wherein the binary output for each air vent of the plurality of air vents includes a high value or a low value, and wherein the air vent is closed when the binary output includes a high value and the air vent is opened when the binary output includes a low value.

17. The method of claim 13, wherein generating the signal includes a multiple digit binary output representation of the integer number.

18. The method of claim 13, wherein determining the integer number of air vents to be placed in the closed position includes receiving, by the controller, an input from a user interface.

19. The method of claim 13, wherein the plurality of air vents are configured to be placed in the open position when power is not applied to the microphone system.

20. The method of claim 19, wherein determining the integer number of air vents to be placed in the closed position includes accessing a predefined integer number stored in the memory upon power being applied to the MEMS microphone.

21. The method of claim 13, further comprising generating, by the controller, a second signal that causes one air vent of the plurality of air vents to transition from the open position to the closed position in response to the second signal.

22. The method of claim 13, further comprising detecting, by the controller, an ambient condition, and wherein determining the integer number of air vents to be placed in the closed position includes using the detected ambient condition.

* * * * *